US006279806B1

(12) United States Patent
Simhaee

(10) Patent No.: US 6,279,806 B1
(45) Date of Patent: Aug. 28, 2001

(54) PLASTIC BAG DISPENSER

(76) Inventor: Ebrahim Simhaee, 112 N. Maple Dr., Beverly Hills, CA (US) 90210

( * ) Notice: Subject to any disclaimer, the term of this patent is extended or adjusted under 35 U.S.C. 154(b) by 0 days.

(21) Appl. No.: 09/373,282

(22) Filed: Aug. 12, 1999

Related U.S. Application Data

(60) Provisional application No. 60/099,427, filed on Sep. 8, 1998.

(51) Int. Cl.[7] ..... B65H 35/10; A47F 13/08
(52) U.S. Cl. ..... 225/106; 225/51; 225/96
(58) Field of Search ..... 225/96, 106, 51

(56) References Cited

U.S. PATENT DOCUMENTS

| | | | |
|---|---|---|---|
| 5,556,019 | 9/1996 | Morris | 225/96 |
| 5,558,262 | 9/1996 | Simhaee | 225/106 |
| 5,573,168 | 11/1996 | Kannankeril et al. | 225/106 |
| 5,813,585 | 9/1998 | Kannankeril et al. | 225/106 |

FOREIGN PATENT DOCUMENTS

| | | | |
|---|---|---|---|
| 2317210 | 2/1977 | (FR) | B65H/35/00 |
| 239595 | 9/1925 | (GB) . | |
| WO97/19013 * | 5/1997 | (WO) . | |
| WO 97/19013 | 5/1997 | (WO) | B65H/35/00 |

* cited by examiner

*Primary Examiner*—Charles Goodman
(74) *Attorney, Agent, or Firm*—Darby & Darby

(57) ABSTRACT

A dispenser is disclosed for retaining and dispensing plastic bags which are wound on a core. The dispenser is made of heavy metal wire configured to provide curved tracks in which a core can ride. The dispenser includes a separating tongue which enables a customer to dispense the bags one by one by pulling on the free end of the outermost bag. In order to prevent freewheeling, a braking surface is provided which engages the roll and retards rotation. A supplemental braking force is provided by spring elements mounted within the tracks which apply a frictional force to the ends of core. The spring elements are oriented such that the force applied to the core by the springs as the roll rotates when the bags are dispensed, causes the roll to tend to move downwardly into engagement with the braking surface. The spring elements are attached to the dispenser at a point below the braking surface. As a result, the braking force applied by the springs increases as the size of the roll decreases.

4 Claims, 7 Drawing Sheets

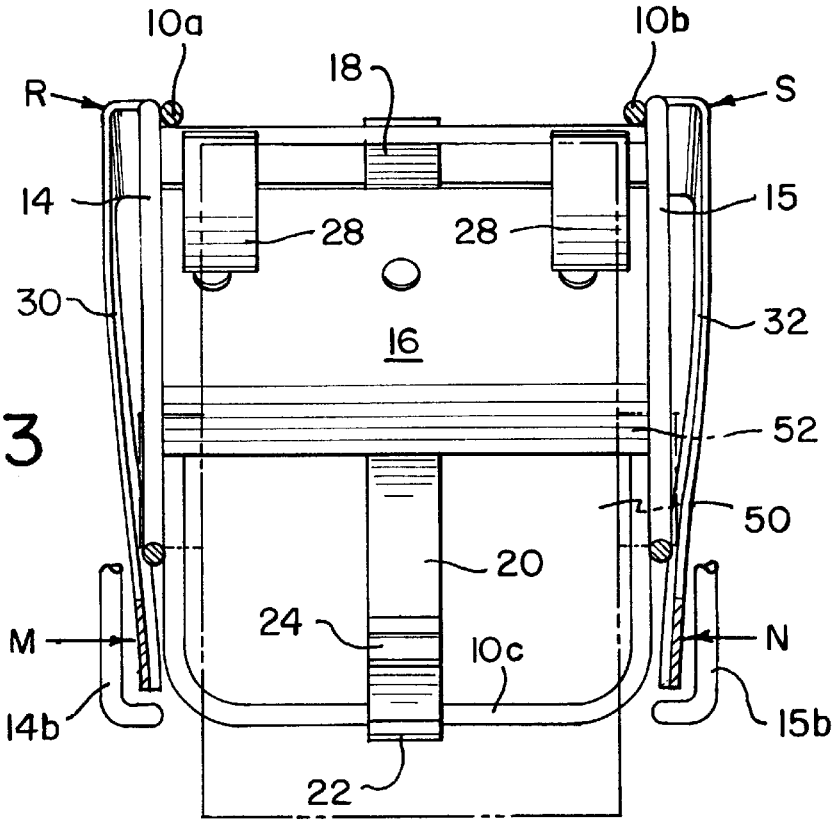
FIG. 3
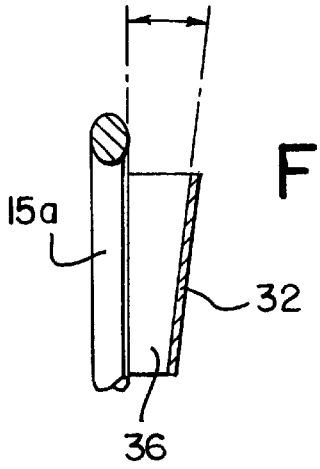
FIG. 4
FIG. 5
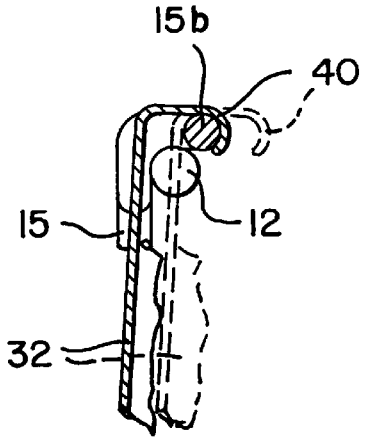

PLASTIC BAG DISPENSER

This application claims priority pursuant to 35 U.S.C. 119 based upon U.S. Provisional Patent Application Serial No. 60/099,427 filed Sep. 8, 1998, the entire disclosure of which is hereby incorporated by reference.

This invention relates to a plastic bag dispensers of the type commonly used in grocery stores for providing bags to customers for packaging produce.

BACKGROUND

U.S. Pat. No. 5,558,262 and its related family of patents disclose dispensers for plastic bags. The bags are provided in a roll with a core which extends beyond the edges of the roll. The bags are separated by a tear line which includes a central slot which engages a separating tongue in the dispenser as the bags are dispensed. From a commercial point of view, it is important to prevent freewheeling of the roll when a consumer pulls the outer bag. To accomplish this objective, a braking surface is provided which contacts the roll. However, because the diameter of the roll (and thus its weight) changes considerably during use (as the bags are dispensed), it is desirable to increase the braking force as the roll is depleted. For this purpose, the tracks in which the roll is supported may be curved so that the relative braking component of force increases as the diameter of the roll decreases.

The current commercial version of the dispenser shown in U.S. Pat. No. 5,558,262 is illustrated and described in U.S. patent application No. 09/036,818 filed on Mar. 9, 1998 and entitled *Plastic Bag Dispenser and Support Mechanism Therefor*. As disclosed in that application, in addition to the force provided by the braking surface of the dispenser, a supplemental braking force is applied to the ends of the core by the sidewalls of the dispenser. However, this force may not always be enough to prevent freewheeling of a small roll while pulling a bag out of dispenser. The sidewalls of the dispenser converge outwardly from the rear surface of the dispenser in order to prevent the roll from riding upwardly as the bags are pulled.

The dispensers shown in U.S. Pat. No. 5,558,262 and application Ser. No. 09/036,818 are made of plastic which, because of static electricity, can attract particles of dust and fluid which may cause discoloration. This problem can be avoided by constructing the dispenser of chrome plated wire as shown in U.S. Pat. No. 5,556,019. The present invention provides a dispenser which operates in much the same way as the dispenser shown in application Ser. No. 09/036,818 but which is manufactured out of metal wire and can supply an extra supplemental braking force to the ends of the core through special spring elements.

U.S. Pat Nos. 5,558,262 and 5,556,019 and U.S. patent application Ser. No. 09/036,818 are hereby incorporated by reference into this application.

SUMMARY OF THE INVENTION

According to one embodiment of the invention, a dispenser for retaining and dispensing plastic bags which are wound on a core, includes wire tracks in the sides of the dispenser, and separate spring elements, preferably in the form of sheet like elements mounted in each of the tracks and adapted to contact the ends of the core to apply a supplemental braking force to the core to retard rotation of the roll as the individual bags are dispensed. In accordance with this embodiment, the spring elements are oriented in such a way that they contact a portion of the core so that rotation of the core as the bags are dispensed causes the roll to move downwardly in the tracks. This braking arrangement enables the tracks as well as most of the remaining portion of the dispenser to be made of wire.

THE DRAWINGS

FIG. 3 is a top sectional view along the line 3—3 of FIG. 2;

FIG. 4 is a sectional view along the line 4—4 of FIG. 2;

FIG. 5 is a front sectional view along the line 5—5 of FIG. 2;

DETAILED DESCRIPTION

Figure 1:
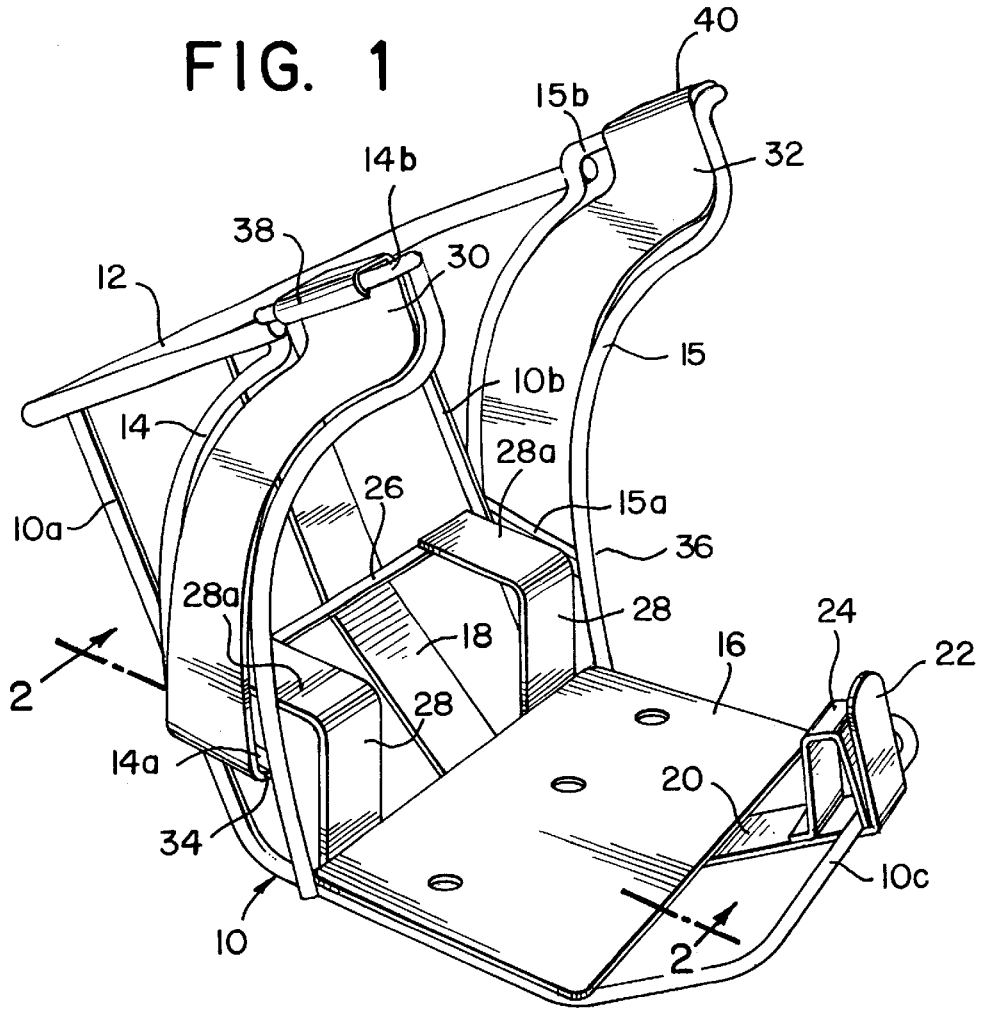
FIG. 1 is a perspective view of a dispenser in accordance with the invention.

The dispenser includes a wire frame which includes a base wire 10 having rear segments 10*a* and 10*b* and a forward segment 10*c*. The base wire 10 preferably is formed from a single wire bent to the configuration shown in the drawings. A U-shaped upper wire 12 is welded to the upper ends of the rear base segments 10*a* and 10*b*. A pair of wire tracks 14 and 15 are welded to the wire base 10 and the forward ends of the upper wire 12.

The wire tracks 14 and 15 are mirror images of each other. Each is formed from a single wire which is bent to the configuration shown in FIG. 1. The wires 14, 15 include lower spring support wires 14*a*, 15*a* and upper retention bars 14*b*, 15*b*. The free ends of the spring support wires 14*a*, 15*a* are welded to the base wire 10.

A mounting plate 16 is welded to the wire base 10, and a rear strap 18 is welded to the cross piece of the U-shaped upper wire 12 and the bottom of the mounting plate 16. A bottom strap 20 extends from the front of the mounting plate 16 and includes an upwardly bent tongue 22 which separates the individual plastic bags as they are pulled past the tongue. A separating finger formed by a U-shaped strap 24 is welded to the bottom strap 20 and forward base segment 10*c* to assist in the separating process. Finger 24 and tongue 22 function in the same way as the finger 128 and tongue 126 of the aforesaid U.S. Pat. No. 5,558,262.

A horizontal braking plate support wire 26 extends between the rear wire segments 10*a* and 10*b* and is welded into place. Two identical braking plates 28 bent as shown in the drawings are welded to the top of the support wire 26 and the bottom surface of the mounting plates 16. The portions of the plates 28 identified as 28*a* function as braking surfaces described below.

In accordance with the invention, a pair of sheet like spring elements 30 and 32 are positioned outside of each of the wire tracks 14 and 15, respectively. The spring elements 30 and 32 include inwardly bent lips 34 and 36, respectively, which are welded to the bottom surface of the spring support wires 14*a* and 15*a*, respectively. The spring elements 30 and 32 include upper U-shaped lips 38 and 40, respectively, which overlap the retention bars 14*b* and 15*b* of the tracks 14 and 15.

The spring support wires 14*a* and 15*a* are parallel to each other; therefore, the welding line between lip 34 and wire 14*a* is parallel to the welding line between lip 36 and wire 15*a*. However, the lips 34 and 36 are bent in such a way that the two bend lines are not parallel but, instead, converge toward the front of the dispenser. In other words, the springs are turned slightly (due to the way in which they are bent) so that the distance between the spring elements 30 and 32 in a horizontal plane is greater at the back of the dispenser than at the front.

Figure 2:
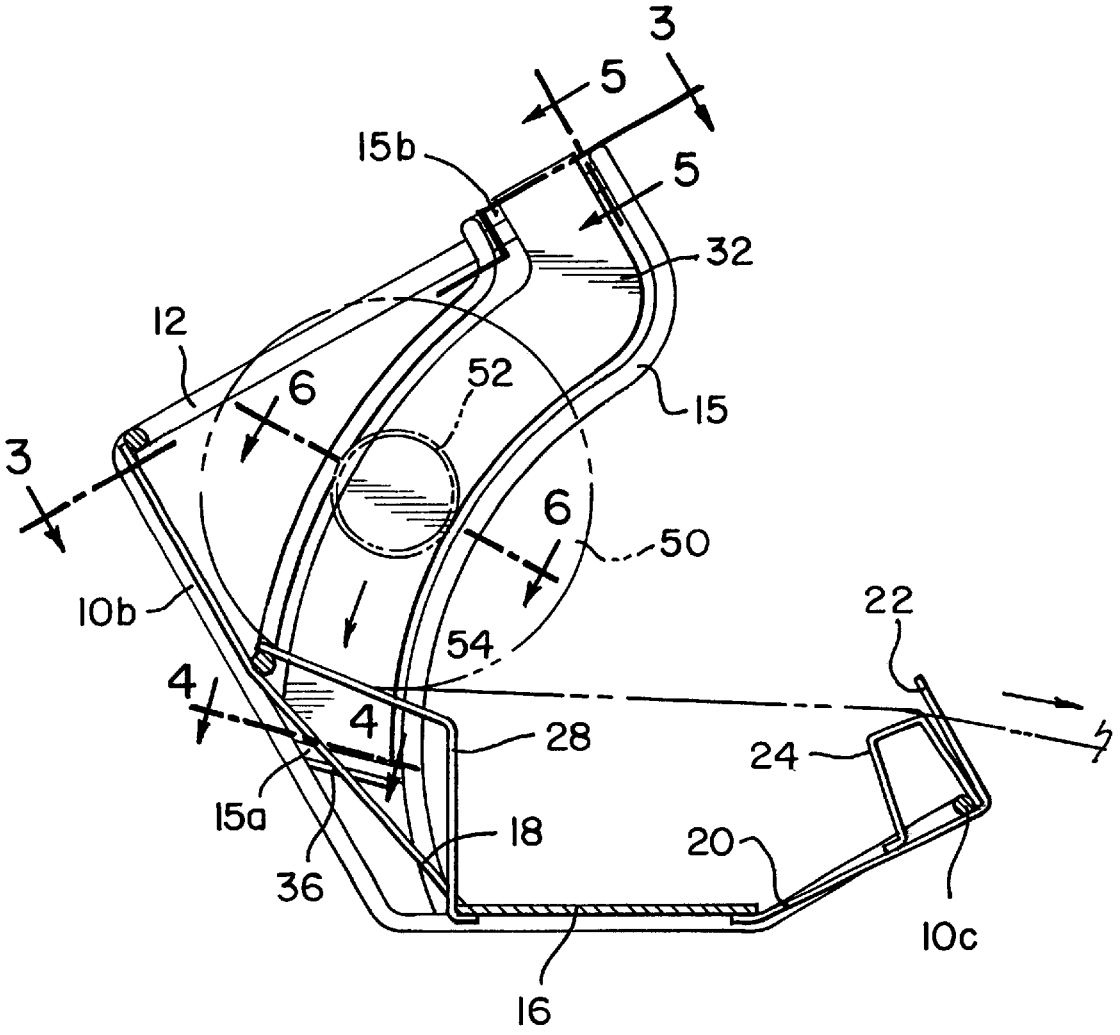
FIG. 2 is a side sectional view along the line 2—2 of FIG. 1 showing the dispenser with a partially depleted roll of plastic bags.
Figure 8:
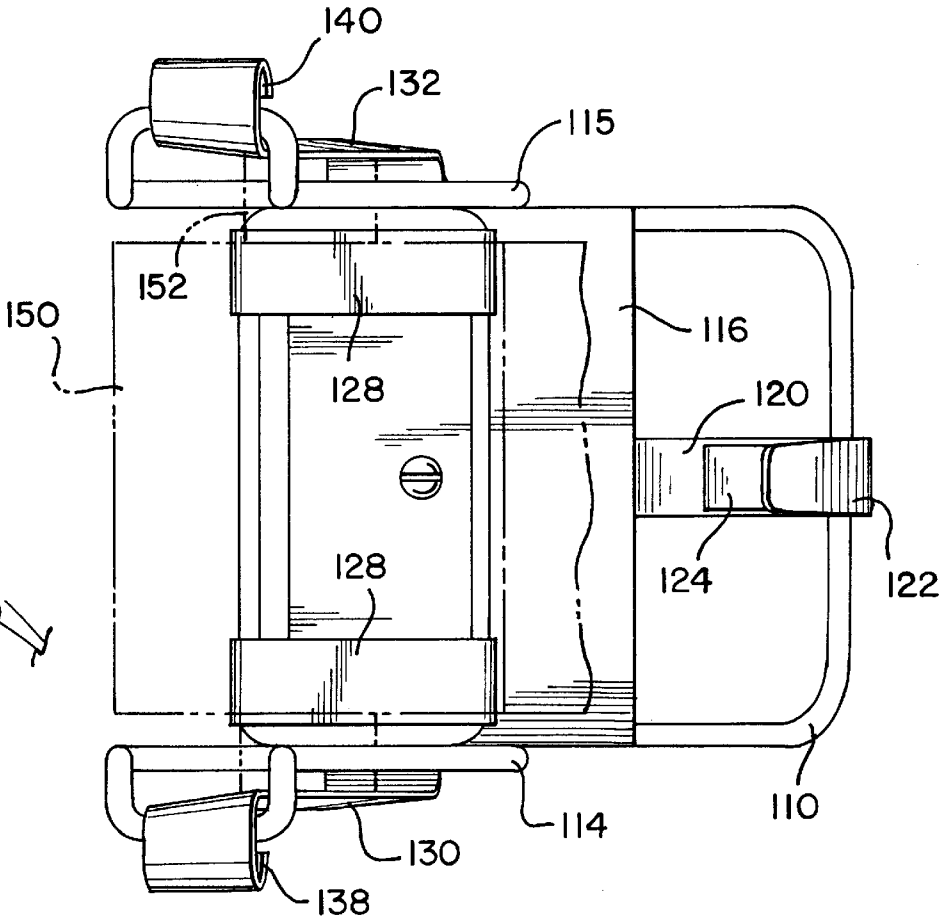
FIG. 8 is a top plan view of the alternative embodiment dispenser of FIG. 7.
Figure 7:
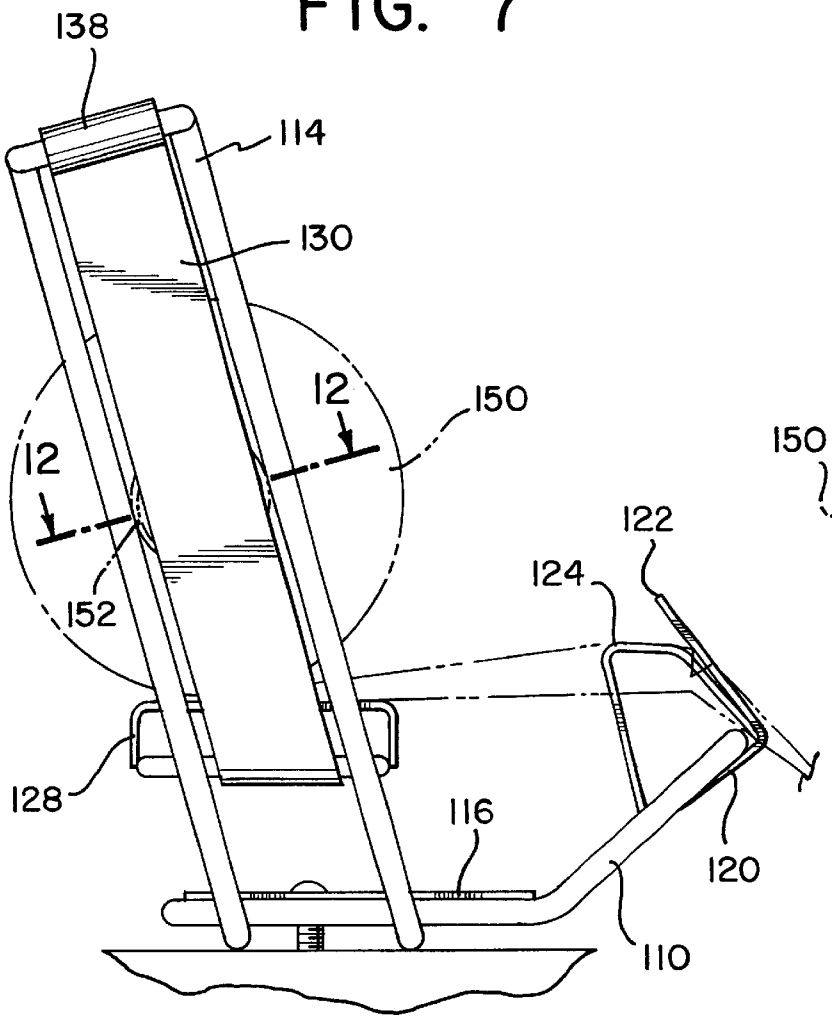
FIG. 7 is a side view of the dispenser showing an alternative embodiment of the wire tracks in accordance with the invention.
Figure 10:
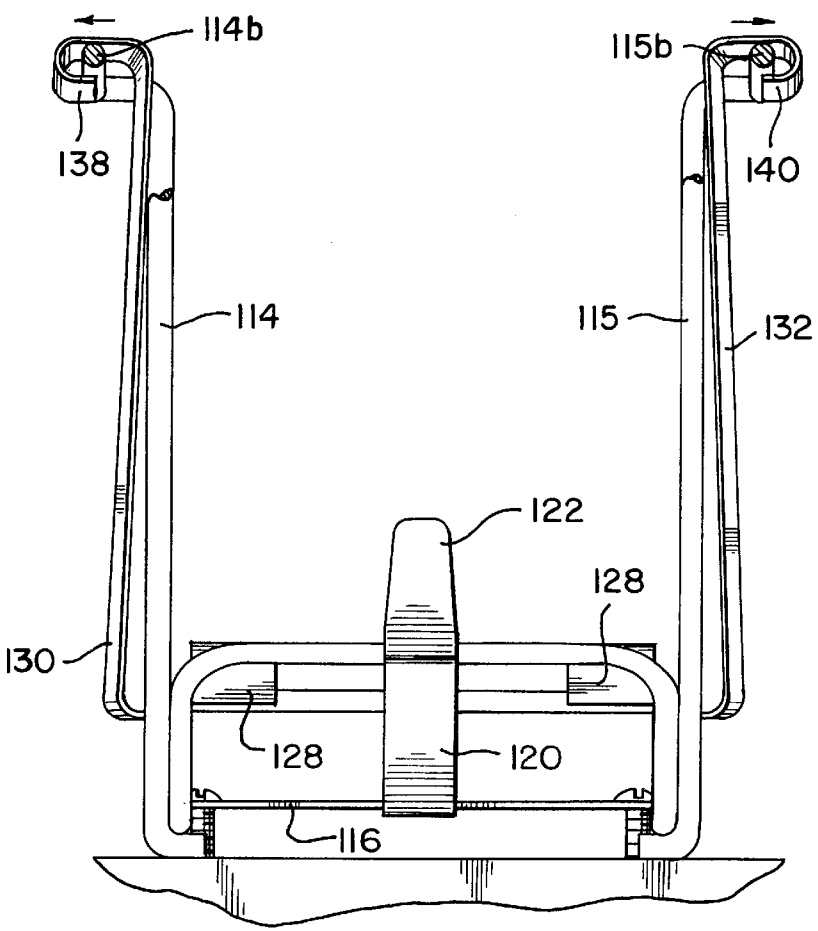
FIG. 10 is a front view of the alternative embodiment dispenser of FIG. 7 showing the dispenser without a roll of plastic bags.
Figure 9:
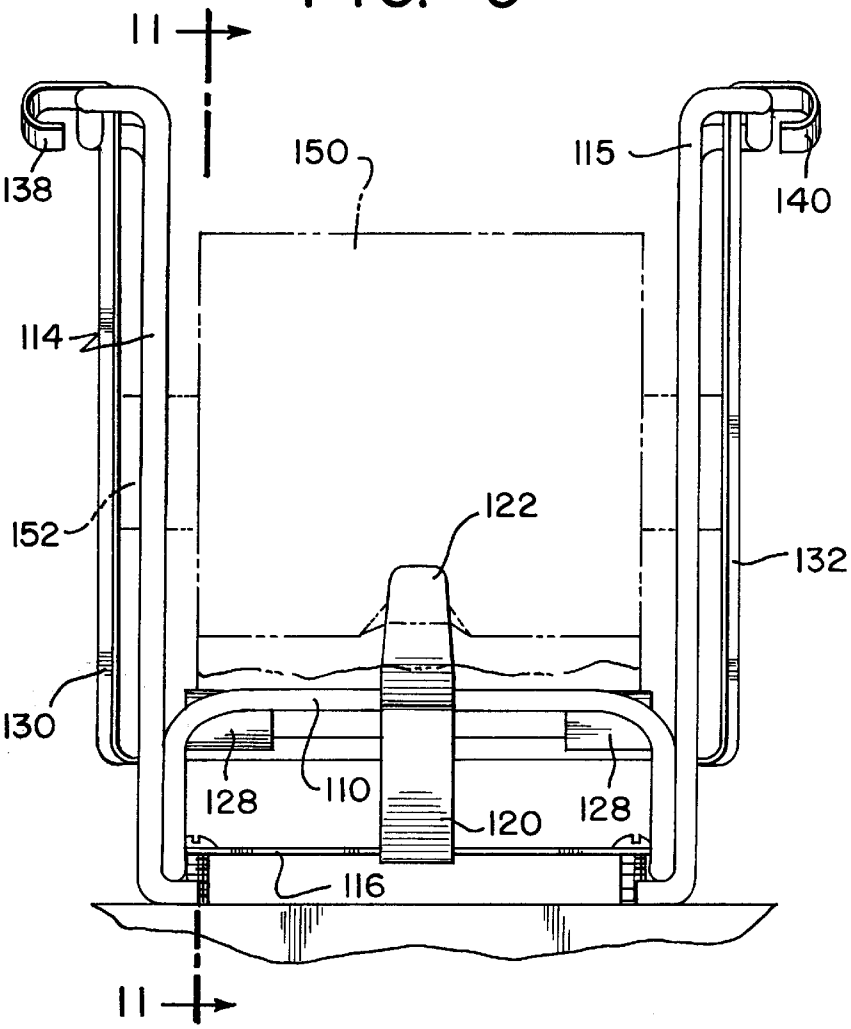
FIG. 9 is a front view of the alternative embodiment dispenser of FIG. 7 showing the dispenser with a roll of plastic bags.
Figure 11:
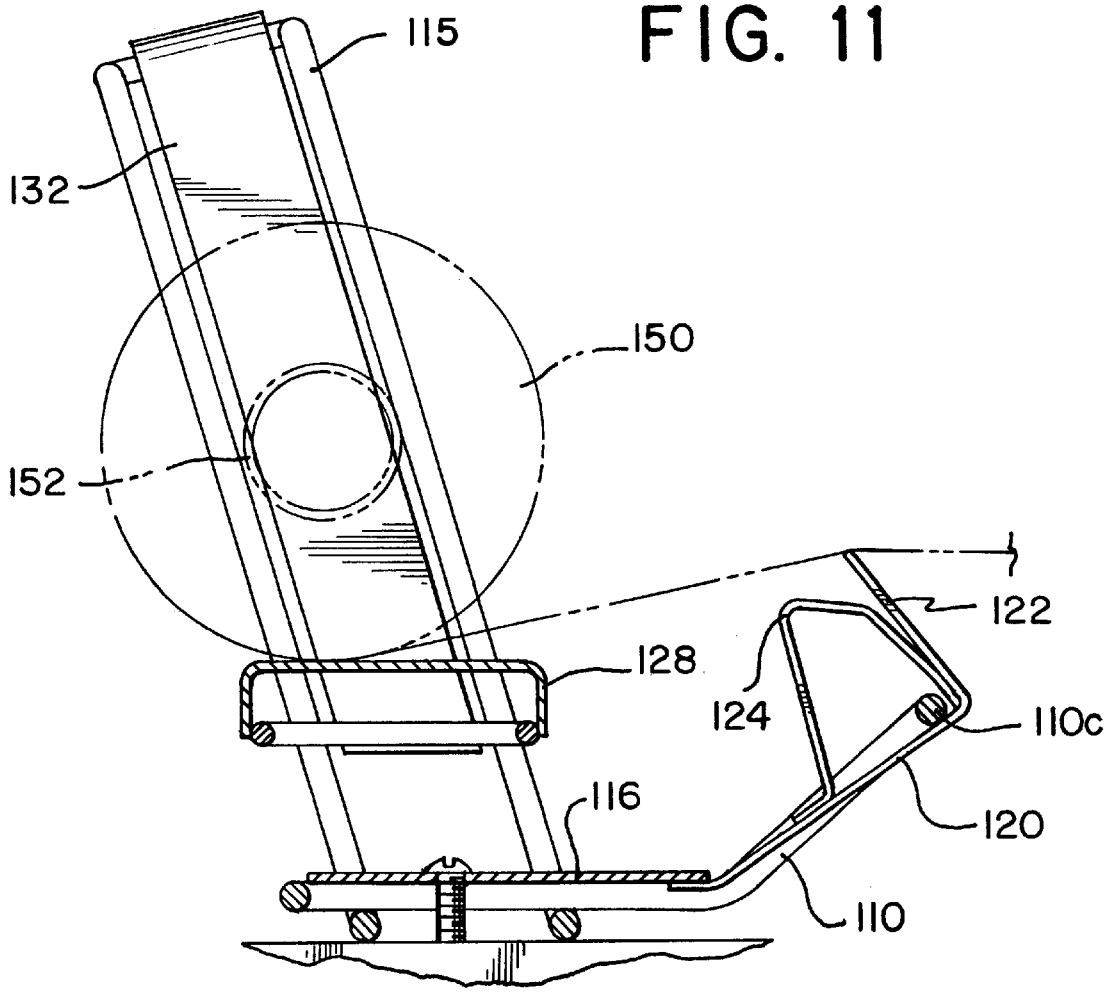
FIG. 11 is a side sectional view along line 11—11 of FIG. 9 showing the core on which the plastic bags are rolled in relation to the wire track and spring element.

The upper ends of spring elements 30 and 32 are spring biased toward each other with the movement of the springs toward each other being limited by abutment of the lips 38 and 40 against retention bars 14*b* and 15*b*, respectively (FIG. 5). Thus, when a roll of plastic bags 50 is inserted in the tracks, the core 52 on which the bags are rolled contacts the two spring elements 30 and 32 with the spring bias applied by the springs acting as a braking force on the core to prevent freewheeling as the bags are dispensed. As in the case of application Ser. No. 09/036,818 and as shown in FIG. 2, the roll also rests on the braking surfaces 28*a* to provide a braking force due to gravity. The curvature of the tracks 14 and 15 is such that the braking force due to gravity relative to the total weight of the roll increases as the roll is depleted.

In one embodiment, and for purposes of example, the length of the core may be 5.15". The distance between spring elements 30 and 32 at the top of the dispenser (Points M and N in FIG. 3) is about 4.75" and the distance between the spring elements at the bottom of the dispenser (points R and S) is about 5.25". The distance between the two at the level of the braking plates 28*a* is about 5". As a result, when the 5.15" length core 52 is inserted between spring elements 30 and 32, the core pushes the two spring elements away from each other. This means that the core 52 is under pressure from the time the roll of plastic bags is full (maximum diameter) to the time that it is depleted (minimum diameter).

In normal use, the dispenser is mounted with the mounting plate 16 horizontal to ground. In this description, reference to a horizontal plane is intended to refer to a plane which is parallel to the mounting plate 16.

The orientation of the two spring elements 30 and 32 is important in the operation of the dispenser. As shown in FIG. 3, since the spring elements are biased toward each other, they converge from the bottom of the tracks to the top, i.e. the distance between the spring elements at the bottom of the tracks is greater than the distance between the spring elements at the top of the tracks. This convergence may be considered a first orientation. As explained in application Ser. No. 09/036,818, this arrangement causes the roll to move toward the bottom of the back of the dispenser within the tracks 14 and 15, with the weight of the roll causing the roll to drop within the tracks as the bags are pulled and the roll unwound. If the spring element planes diverged from bottom to top, the springs would apply a component of force to the core which would cause the roll to tend to move toward the front top within the tracks 14 and 15, guiding the roll upwardly and away from the braking surfaces 28*a*.

When the roll is very small, the weight of the roll and the above backward directed force may not be enough to prevent freewheeling of the roll. In the second orientation, the spring elements 30 and 32 are turned slightly so that when the roll is loaded in the dispenser, the spring elements converge in a horizontal plane from their back edges to their front edges (see FIG. 6).

Figure 6:
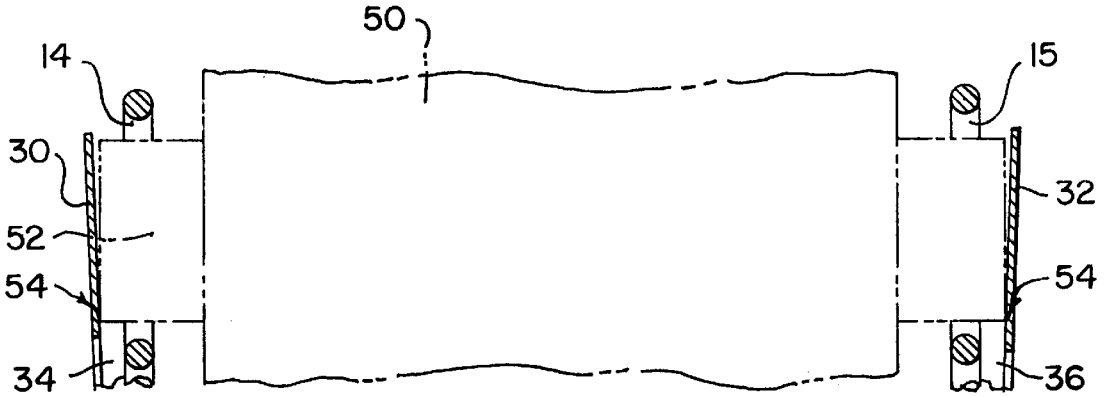
FIG. 6 is a sectional view along the line 6—6 of FIG. 2 showing the way in which the core contacts the spring elements.

In this embodiment of the invention, the roll of plastic bags is placed in the dispenser and pulled from the bottom (see FIG. 2). This causes the roll to rotate in a counter-clockwise direction. Because the spring elements are turned as shown in FIG. 6, they tend to contact the forward regions of the core on which the plastic bags are rolled, and because the spring elements are pushed apart by the core, they tend to contact the bottom regions of the core. The combination of these forces and the effect of the weight of the plastic roll cause the lower edges of the spring elements to contact the ends of the core in a relatively small area 54 toward the front of the core as shown in FIG. 6. In the case where pulling the bags causes the core to rotate in a counter-clockwise direction, this lower-forward area of contact, causes a component of force to be applied to the core which tends to move it downwardly, i.e. against the braking surfaces 28*a*. If the spring elements were turned in the opposite way, when the roll is small and near the bottom of the tracks, the force applied to the core as it is rotated counter-clockwise would cause the small roll to move away from the braking surfaces 28*a* which is highly undesirable.

Because the spring elements 30 and 32 are welded to the spring support wires 14*a* and 15*a*, respectively, the wires 14*a* and 15*a* effectively serve as a fulcrum for the spring elements. The braking force supplied by the first orientation of the spring elements to the core 52 is relatively low when the roll is new or big, since the distance between the core and the support wires 14*a* and 15*a* is large and the spring elements flex more readily because the core is close to their free ends. As the roll is depleted and the core drops in the tracks, since the distance between the core and the wires 14*a* and 15*a* decreases, the braking force applied by the spring elements to the core increases because flexibility of the spring elements decreases. With the spring support wires 14*a* and 15*a* positioned beneath the braking surfaces 28*a* on which the roll rests, the spring elements will apply a higher braking force to the core as the bags are dispensed from the roll. Thus, when only a few bags are left on the roll, and the core is close to the fulcrum, the braking force due to the spring elements is sufficiently high to prevent freewheeling.

Likewise, with respect to the second orientation, because the stiffness of the spring elements increases as the core drops in the tracks, the component of force applied by the springs due to the second orientation (i.e., turning the spring elements so that they converge from back to front in a horizontal plane)increases as the roll is depleted. This additional braking force compensates further for the reduced braking which results from the decrease in weight of the depleted roll.

The dispenser shown in FIGS. 1–6 is essentially a wire analog of the plastic dispenser shown in application Ser. No. 09/036,318 in which the curvature of the tracks plays an important part in braking the rotation of the roll as the bags are dispensed. In practice, it has been discovered that this change in braking force as the roll diminishes is of minor importance in the case of the metal wire dispenser and that the required supplemental braking can be provided by means of the spring elements which apply pressure to the ends of the core. FIGS. 7–12 and 13–14, respectively, show two embodiments in which the tracks are not curved. As explained below, these two embodiments are very much alike. They differ from the embodiment of FIGS. 1–6 in that no provision is made for adjusting the braking force due to gravity as the roll of bags diminishes in size. As a result of the straight tracks, the spring elements can be made of a heavier gauge steel.

Figure 12:
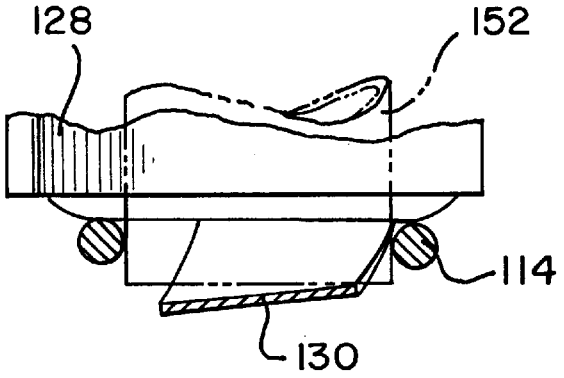
FIG. 12 is a partial sectional view along line 12—12 of FIG. 7 showing the way in which the spring element is oriented so that it contacts the front lower edge of the core on which the plastic bags are rolled.
Figure 14:
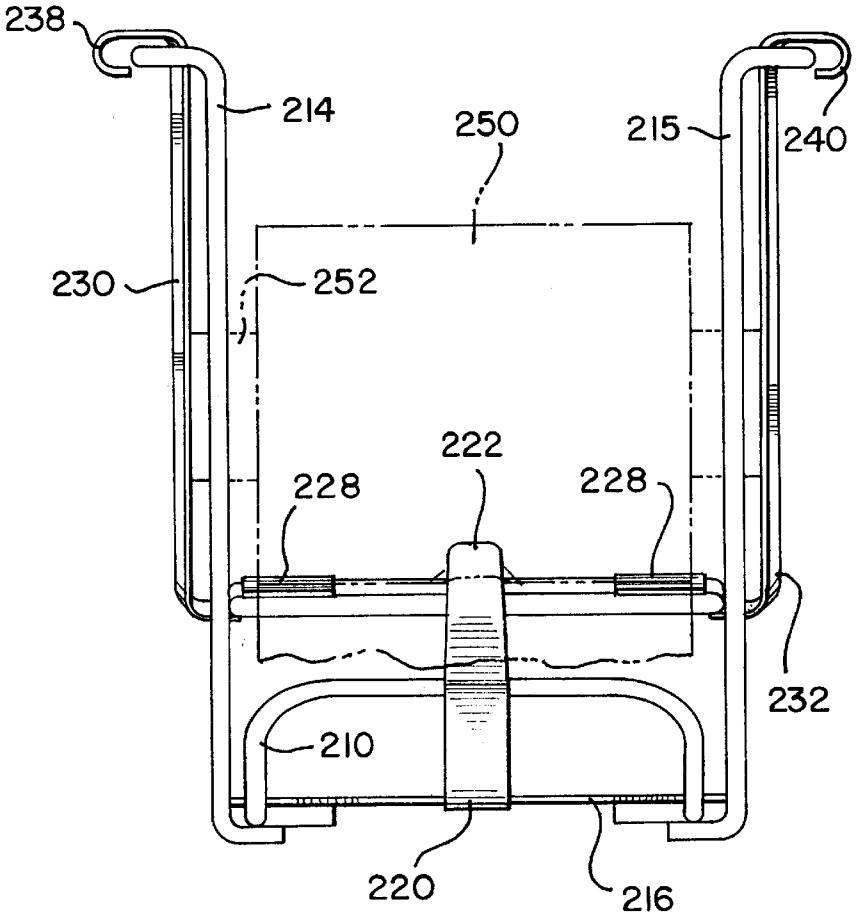
FIG. 14 is a front view of the second alternative embodiment dispenser of FIG. 13 showing the dispenser with a roll of plastic bags.
Figure 13:
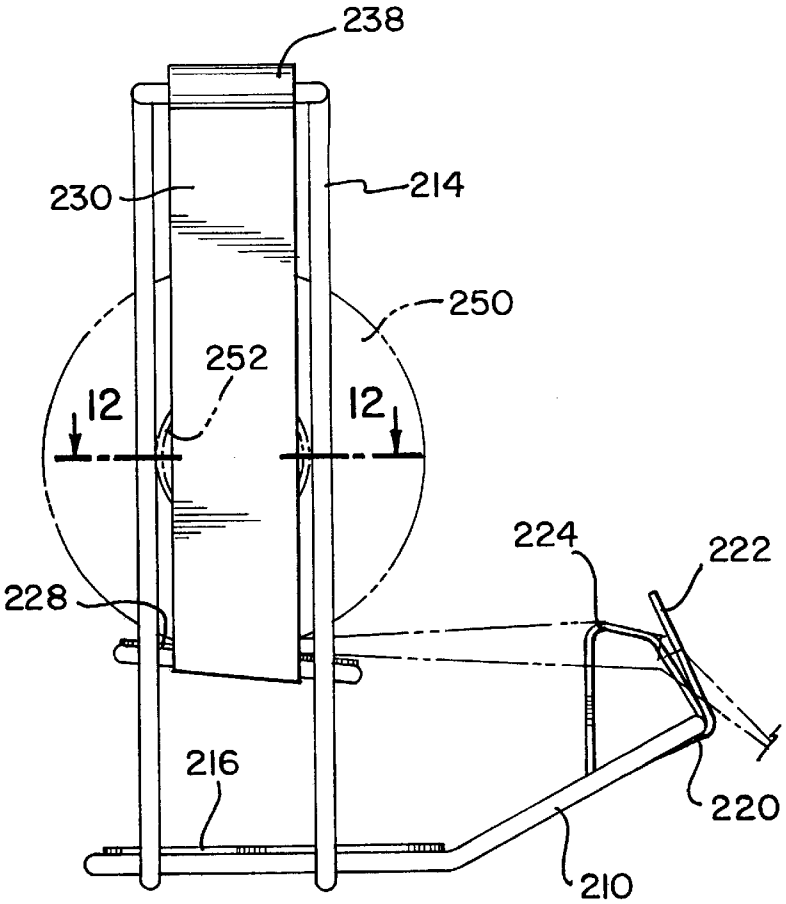
FIG. 13 is a side view of the dispenser showing a second alternative embodiment of the wire tracks in accordance with the invention.

The embodiments of FIGS. 7–14 each include two straight wire tracks 114 and 115 (FIGS. 7–12) and 214 and 215 (FIGS. 13–14). The spring elements 130 and 132 (FIGS. 7–12) and 230 and 232 (FIGS. 13–14) correspond to the spring elements 30 and 32 of the FIGS. 1–6 embodiment. In addition, the braking plates 128 (FIGS. 7–12) and 228 (FIGS. 13–14) operate in the same manner as the FIGS. 1–6 braking plates 28. The spring elements 130, 132 and 230, 232 are located in the straight wire tracks 114, 115 and 214, 215, and may supply the same supplemental braking force to the cores 152 (FIGS. 7–12) and 252 (FIGS. 13–14) as the FIGS. 1–6 spring elements 30 and 32 provide to the core 52. This braking force is adequate to retard rotation of the roll as the bags are dispensed. The spring elements 130, 132 and 230, 232 are oriented so as to ensure that when the roll is pulled from the bottom (as is preferred), the spring elements will contact lower forward portions of the cores 152 and 252, respectively, so that the counter-clockwise rotation of the cores as the bags are dispensed causes the rolls to move downwardly in the tracks. That is, the spring elements converge in a horizontal plane from back to front as shown in FIG. 12 and converge in a vertical plane from the bottom to the top of the tracks.

The difference between the embodiments of FIGS. 7–12 and FIGS. 13 and 14 is in the angle of the tracks in which the core rides. In the embodiment of FIGS. 7–12 the track is at a slight angle with respect to vertical (see FIGS. 7 and 11). In the embodiment of FIGS. 13 and 14, the tracks are vertical (see FIG. 13). Because of the slight angle of the tracks in the embodiment of FIGS. 7–12, the braking force due to gravity is slightly attenuated and, in practice, this embodiment is preferred.

Having thus described the present invention, it is to be understood that the above-described device embodiments are illustrative of the principles of this invention and that other device embodiments may be devised by those skilled in the art, without departing from the spirit and scope of the invention. Accordingly, the invention is not limited by the specific examples illustrated herein, but by the appended claims.

What is claimed is:

1. A plastic bag dispenser for retaining and dispensing from the front of the dispenser plastic bags wound on a core in a roll, the dispenser having a front, back and opposite sides, wherein the core has two ends and rides in spaced apart tracks, the tracks being disposed on the opposite sides of the dispenser, the improvement comprising a pair of planar spring elements wherein each of the tracks has one of the spring elements mounted therein, wherein the spring elements each have a front, back, top and bottom ends, with the bottom ends attached to the bottom of the dispenser and the upper ends unattached, and are adapted to contact the ends of the core for applying a braking force to the core for retarding rotation of the roll when individual bags are dispensed, the spring elements being oriented at an angle with respect to each other so that the front ends of the spring elements converge toward each other from the back of the dispenser toward the front of the dispenser, and the top ends of the spring elements also converge toward each other from their bottom ends such that rotation of the core as the individual bags are dispensed causes the roll to tend to move downwardly in the tracks.

2. A dispenser according to claim 1, wherein said tracks are formed from metal wire.

3. A dispenser according to claim 2, further including a braking surface on which the roll rests, wherein the spring elements are attached to the dispenser at a point below said braking surface.

4. A dispenser according to claim 1, further including a braking surface on which the roll rests, wherein the spring elements are attached to the dispenser at a point below said braking surface.

* * * * *